US009039375B2

(12) United States Patent
Kneeland et al.

(10) Patent No.: US 9,039,375 B2
(45) Date of Patent: May 26, 2015

(54) NON-AXISYMMETRIC AIRFOIL PLATFORM SHAPING

(75) Inventors: Andrew Ray Kneeland, Simpsonville, SC (US); Andres Jose Garcia-Crespo, Greenville, SC (US); Bradley T. Boyer, Greenville, SC (US); Thomas William Vandeputte, Simpsonville, SC (US); Sylvain Pierre, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1519 days.

(21) Appl. No.: 12/551,741

(22) Filed: Sep. 1, 2009

(65) Prior Publication Data

US 2011/0052387 A1 Mar. 3, 2011

(51) Int. Cl.
*F01D 5/14* (2006.01)
*F01D 11/02* (2006.01)

(52) U.S. Cl.
CPC ..... *F01D 5/141* (2013.01); *F01D 5/143* (2013.01); *F01D 11/02* (2013.01); *F01D 5/142* (2013.01)

(58) Field of Classification Search
USPC ..... 415/173.6, 208.1, 208.2, 209.1, 209.4, 415/210.1, 228, 173.7; 416/193 A, 189, 191
See application file for complete search history.

(56) References Cited

U.S. PATENT DOCUMENTS

| | | | | |
|---|---|---|---|---|
| 3,891,351 | A | 6/1975 | Norbut | |
| 4,012,172 | A | 3/1977 | Schwaar et al. | |
| 4,720,239 | A | 1/1988 | Owczarek | |
| 5,230,603 | A | 7/1993 | Day | |
| 5,967,745 | A * | 10/1999 | Tomita et al. | 415/173.7 |
| 6,435,814 | B1 | 8/2002 | Yu et al. | |
| 6,506,013 | B1 | 1/2003 | Burdgick et al. | |
| 6,558,121 | B2 | 5/2003 | Zhu et al. | |
| 6,837,676 | B2 * | 1/2005 | Yuri et al. | 415/115 |
| 7,195,454 | B2 * | 3/2007 | Lu et al. | 415/181 |
| 8,186,952 | B2 * | 5/2012 | Tibbott | 416/95 |
| 2004/0081548 | A1 | 4/2004 | Zess et al. | |
| 2005/0100439 | A1 | 5/2005 | Greim et al. | |
| 2006/0207261 | A1 | 9/2006 | Venkataramani et al. | |
| 2007/0224035 | A1 * | 9/2007 | Nigmatulin | 415/170.1 |
| 2010/0172749 | A1 | 7/2010 | Mitsuhashi et al. | |

FOREIGN PATENT DOCUMENTS

| | | |
|---|---|---|
| JP | 2003-254005 | 9/2003 |
| JP | 2004-036510 | 2/2004 |
| JP | 2004-084539 | 3/2004 |
| JP | 2004-100578 | 4/2004 |
| JP | 2006-002609 | 1/2006 |
| JP | 2006-077658 | 3/2006 |
| WO | 2008-120748 | 10/2008 |

OTHER PUBLICATIONS

Office Action issued in Japanese Patent Appl 2010-187743 on Mar. 18, 2014.

* cited by examiner

*Primary Examiner* — Dwayne J White
*Assistant Examiner* — Justin Seabe
(74) *Attorney, Agent, or Firm* — Nixon & Vanderhye P.C.

(57) ABSTRACT

Turbine blade assemblies of a turbine include airfoils that are mounted on bases. The leading and/or trailing edges of the bases are provided with curved portions. Likewise, curved portions may be provided on leading and/or trailing edges of the angle wings of a turbine blade assembly. Also, curved portions may be provided on the leading and/or trailing edges of nozzle assemblies of a turbine.

15 Claims, 11 Drawing Sheets

NON-AXISYMMETRIC AIRFOIL PLATFORM SHAPING

BACKGROUND OF THE INVENTION

The invention is related to turbines which include turbine blades connected to a rotating shaft of the turbine and nozzles which direct steam or combustion gases to the nozzles.

In a typical turbine used in the power generation industry, fuel is burned in a combustion zone and the hot combustion gases are then directed to the turbine section. In the turbine section, as illustrated in FIG. 1, a plurality of blade assemblies are mounted on a rotating shaft 16. The blade assemblies are attached around the exterior circumference of the rotating shaft 16. Each row of blade assemblies is positioned between an adjacent pair of rows of nozzles or vanes 16, 20. As shown in FIG. 1, a first row of turbine blades 22 is positioned between an adjacent pair of nozzles 18 and 20.

The first row of nozzles 18 directs the hot combustion gases in a desired direction as it impinges upon the turbine blades 22. The passage of the combustion gas over the turbine blades exerts a force on the blades that causes the attached shaft 16 to rotate. FIG. 2 illustrates a typical blade assembly which would be attached to a rotating shaft of the turbine. The blade assembly includes a mounting portion 10 which physically couples the blade assembly to the rotating shaft. A base 45 is attached to the top of the mounting portion 10. A blade 40 extends upward from the top surface of the base 45.

The space located inside the nozzles and blades, close to the center of the turbine, is typically referred to as the wheel space 15. As noted above, hot combustion gases are passing the direction of arrow 38, as shown in FIG. 1. The pressure in the gas flow path across the nozzles in the blades tends to be lower than the pressure in the wheel space 15. As a result, any gas located in the wheel space 15 tends to move outward and into the hot gas path 38.

There are localized variations in ambient pressure in the hot gas flow path. For instance, the pressure at the leading edge of each of the blades 40 tends to be higher than the pressure on either side of the blade 40. In some instances, this can result in the pressure adjacent the leading edge of the turbine blades becoming greater than the pressure in the wheel space 15. When this occurs, hot combustion gases from the gas flow path 38 can penetrate downward into the wheel space 15. This essentially represents a loss of the hot combustion gases into the wheel space, which reduces the overall efficiency of the turbine.

One attempt to prevent the hot combustion gases from penetrating down into the wheel space was to add angel wings 32, 33, 34, 35 to the leading and trailing edges of the base of the blade assemblies. Corresponding projections 36 are formed on the leading and trailing edges of the nozzle assemblies. The angel wings on the blade assemblies and the corresponding projections on the nozzle assemblies help to prevent the hot combustion gases from penetrating down into the wheel space. Nevertheless, there is still a problem with loss of the hot combustion gases, which represents an undesirable inefficiency of the turbine.

BRIEF DESCRIPTION OF THE INVENTION

In one aspect, the invention may be embodied in a blade assembly for a turbine that includes a mounting portion that is configured to be coupled to a rotating shaft of a turbine, a base that is formed on top of the mounting portion, wherein at least one of a leading edge and a trailing edge of the base includes a curved portion, and a blade that extends upward from the top of the base.

In another aspect, the invention may be embodied in a stationary nozzle assembly that includes a first mounting portion that is configured to be attached to an interior of a turbine casing, a nozzle blade having a first end attached to the first mounting portion, and a second mounting portion attached to a second end of the nozzle blade, wherein the second mounting portion comprises a nozzle base having leading and trailing edges, and wherein at least one of the leading and trailing edges of the nozzle base includes a curved portion.

DETAILED DESCRIPTION OF THE INVENTION

Figure 2:
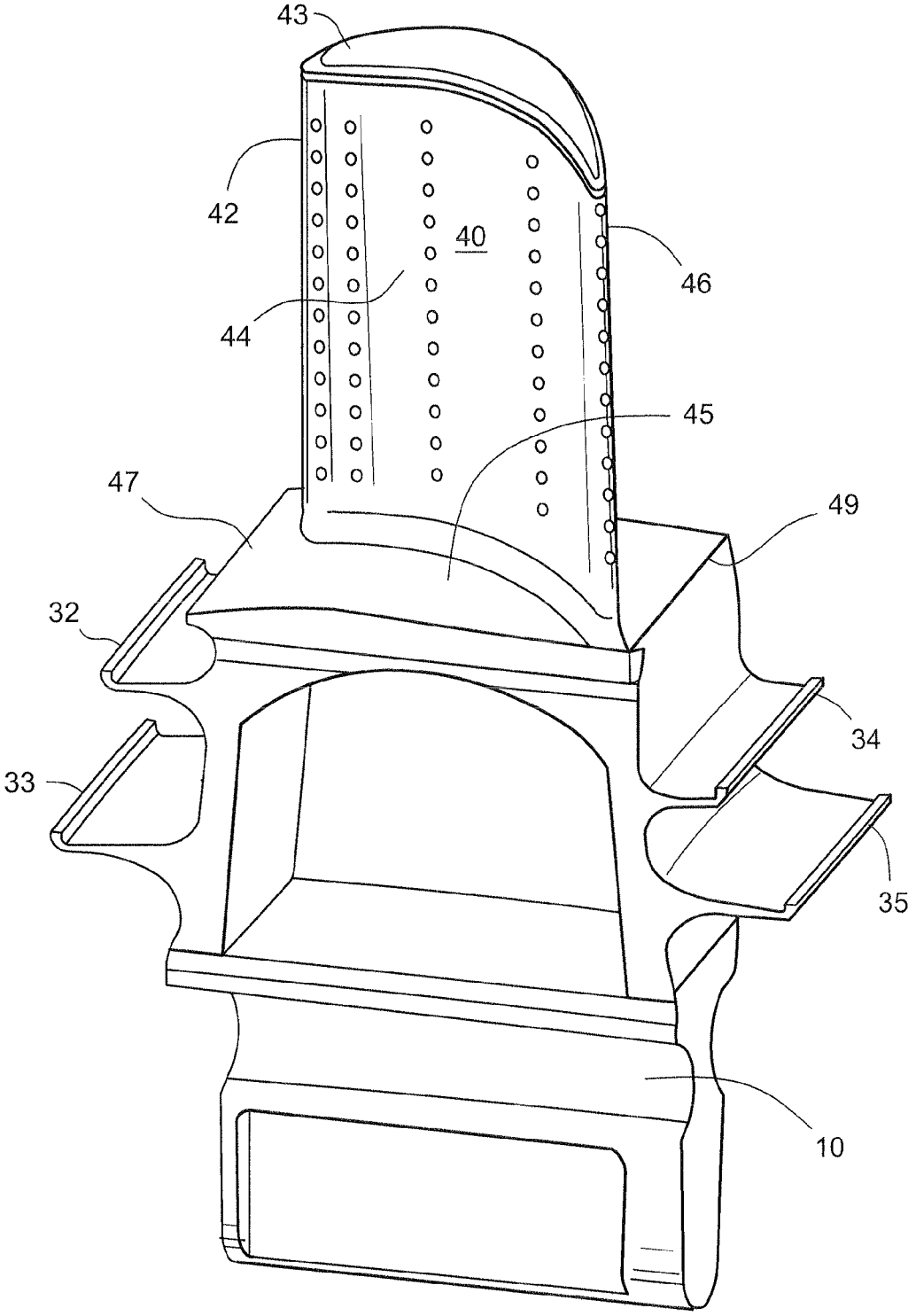
Fig. 2 Background Art
FIG. 2 is a perspective view of a turbine blade assembly.

As explained above, angel wings had been added to turbine blade assemblies, as shown in FIG. 2, to help prevent the hot combustion gases from the hot gas flow path from penetrating down into the wheel space of a turbine. In the blade assembly illustrated in FIG. 2, two angel wings 32 and 33 are formed on the leading side of the blade assembly, and two angel wings 34 and 35 are formed on the rear side of the blade assembly. In addition, the base upon which the blade is mounted includes a leading edge 47 and a trailing edge 49. The blade 40 extends upward from the base 45 and also includes a leading edge 42 and a trailing edge 46. A cap 43 is formed on the top of the blade 40.

Figure 1:
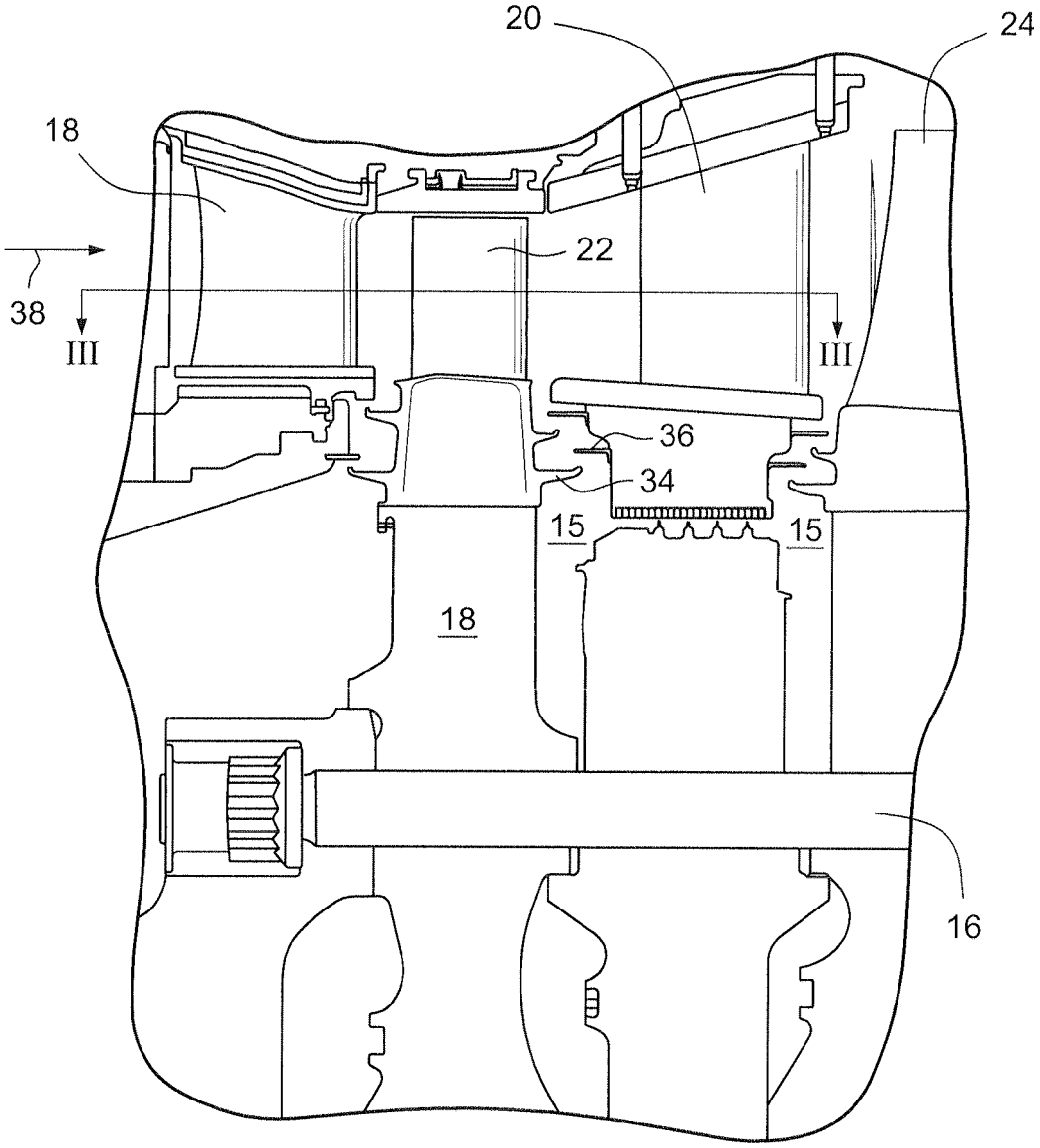
Fig. 1 Background Art
FIG. 1 is a cross-sectional view of a portion of a turbine.
Figure 3:
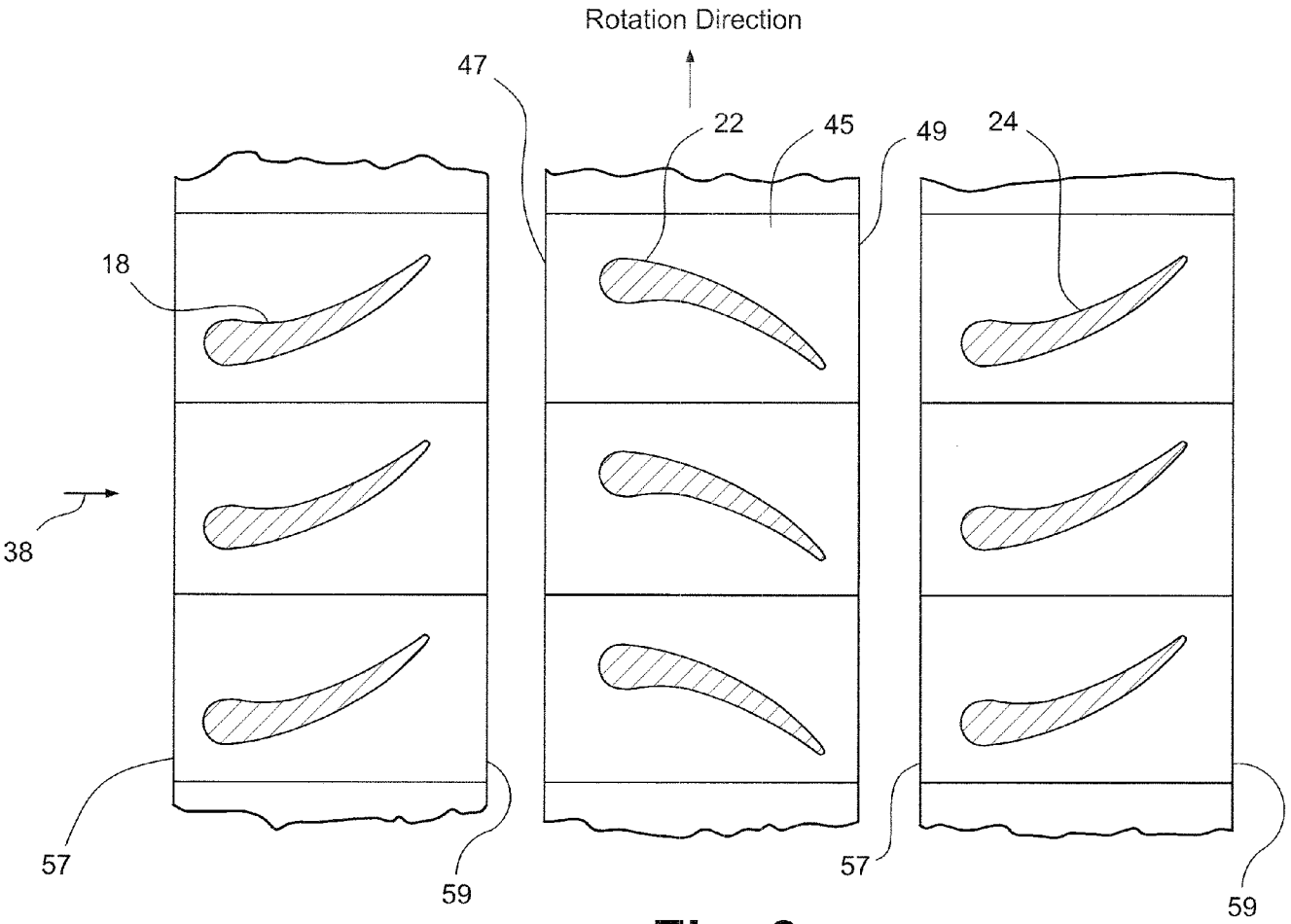
Fig. 3 Background Art
FIG. 3 is a partial cross-sectional view showing in a row of turbine blades positioned between two adjacent rows of nozzles.

FIG. 3 is a part cross-sectional view taken along line in FIG. 1. The cross section cuts through three adjacent turbine blades which are attached to a rotating shaft of the turbine. The row of turbine blades is positioned between two adjacent rows of nozzles. In FIG. 3, the row of nozzles on the left would correspond to the upstream side of the turbine blades, and the row of nozzles on the right would correspond to the downstream side of the turbine blades. The arrow 38 shows the direction of the flow of the hot combustion gases. As also indicated in FIG. 3, when the hot combustion gases flow through the hot gas flow path, the combustion gases will cause the turbine blades 22 to rotate in the direction of the indicator arrow.

As illustrated in FIG. 3, there is necessarily a very small gap located between the trailing edges 59 of the bases of the upstream nozzles and the leading edge 47 on the bases of the turbine blade assemblies. Likewise, there is a small gap between the trailing edges 49 of the turbine blade assemblies and the leading edges 57 of the bases on the downstream nozzles. The gaps between adjacent nozzles and turbine blade assemblies provide a flow path that hot gases can escape into as explained above. As also explained above, the angel wings on the leading and trailing sides of the blade assemblies and the corresponding projections on the nozzles assemblies are intended to reduce the escape of the hot combustion gases into these gaps.

As also explained above, the high pressure regions created in front of the leading edges of both the turbine blades and the nozzles are one of the factors which can give rise to or cause the hot combustion gases to descend into the wheel space. Accordingly, the inventors believe that to the extent hot combustion gases are penetrating down into the wheel space, the penetration likely occurs adjacent the leading edges of the turbine blades and the nozzle blades.

Figure 4:
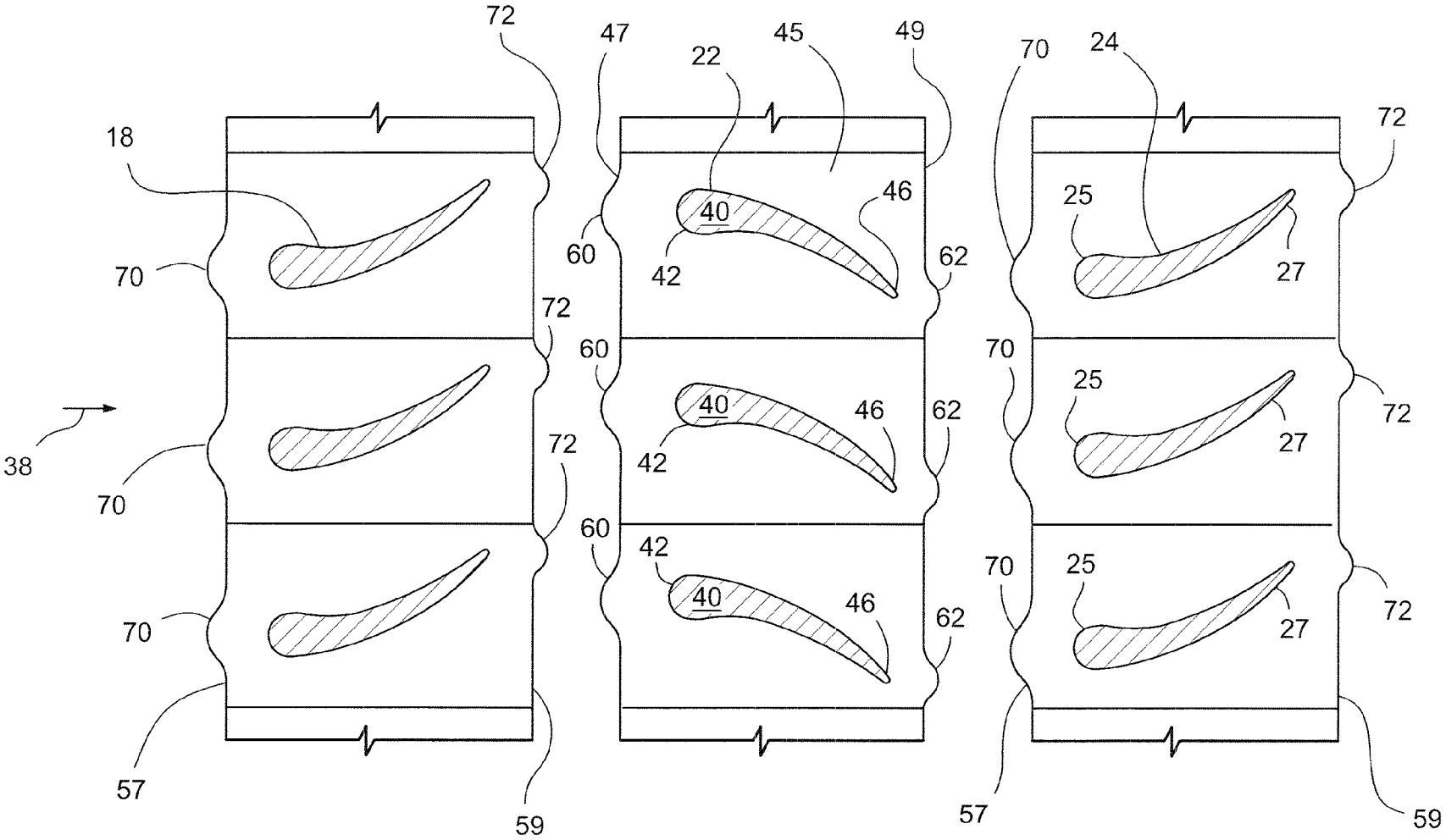
FIG. 4 is a partial cross-sectional view showing in a row of turbine blades positioned between two adjacent rows of nozzles.

To help prevent the hot combustion gases from penetrating down into the wheel space, the inventors propose to add curved portions to the leading and/or trailing edges of the bases of the turbine blade assemblies. FIG. 4 shows one embodiment where curved portions 60 are formed on the leading edge 47 of the bases of each of the turbine blade assemblies. In the embodiment illustrated in FIG. 4, the curved portions 60 on the leading edges 47 of the turbine blade assemblies are located adjacent the leading edges of the turbine blades 40 themselves.

The curved portions 60 on the leading edge 47 of the turbine blade assemblies may help to prevent hot combustion gases in the hot gas flow path from penetrating down into the wheel space. This would occur because the curved portion extends the top surface of the base of the turbine blade assemblies in the forward direction away from the leading edges 42 of the turbine blades 40. In addition, as the turbine blades rotate within the turbine, the curved portions 60 will actually be passing through the gas located between the leading edge of the turbine blade assemblies and the trailing edges of the upstream nozzle assemblies. The curved portions would essentially act as an airfoil, thereby reducing the pressure at the locations of the curved portions. Because the curved portions are located directly in front of the leading edges 42 of the turbine blades 40, which is the very location where hot combustion gases are likely to penetrate into the wheel space, the existence of the curved portions 60 at these locations should further serve to prevent the hot combustion gases from penetrating into the wheel space.

The embodiment illustrated in FIG. 4 also includes curved portions 62 located on the trailing edges 49 of the bases of the turbine blade assemblies. As illustrated in FIG. 4, the curved portions 62 are located adjacent the trailing edges 46 of the turbine blades 40. The hot combustion gases may also tend to penetrate into the wheel space at locations adjacent the trailing edges 46 of the turbine blades 40. Accordingly, locating curved portions 62 on the trailing edges 49 of the bases of the turbine blade assemblies could also help to prevent the hot combustion gases from penetrating into the wheel space.

For the same reasons described above, the pressure located in front of the leading edges 25 of the nozzles is also likely to be higher than normal, which can cause the hot combustion gases to penetrate down into the wheel space adjacent the leading edges 57 of the nozzle assemblies. Accordingly, it may be beneficial to provide curved portions 70 on the leading edges 57 of the nozzle assemblies. As shown in FIG. 4, in some embodiments the curved portions 70 would be located directly in front of the leading edges 25 of the nozzle blades. Likewise, curved portions 72 would also be formed on the trailing edges 59 of the nozzle assemblies at positions corresponding to the trailing edges 27 of the nozzles.

Figure 5:
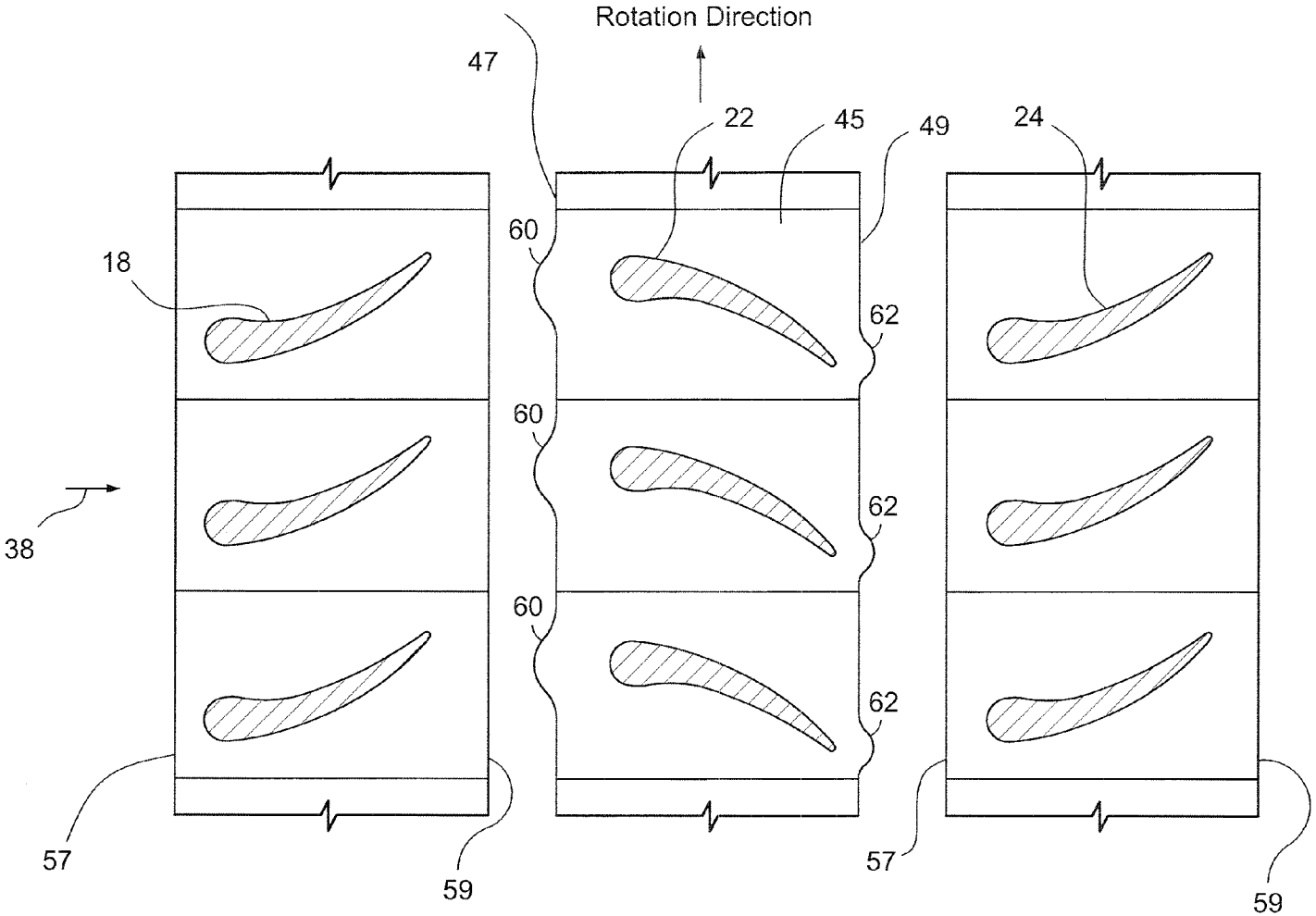
FIG. 5 is a partial cross-sectional view showing in a row of turbine blades positioned between two adjacent rows of nozzles.

FIG. 5 illustrates another alternate embodiment where curved portions are only formed on the leading and trailing edges of the turbine blade assemblies. As shown in FIG. 5, curved portions 60 are formed on the leading edges 47 of the turbine blade assemblies at locations corresponding to the leading edges of the turbine blades. Likewise, curved portions 62 are formed on the trailing edges 49 of the turbine blade assemblies at locations corresponding to the trailing edges of the turbine blades.

Figure 6:
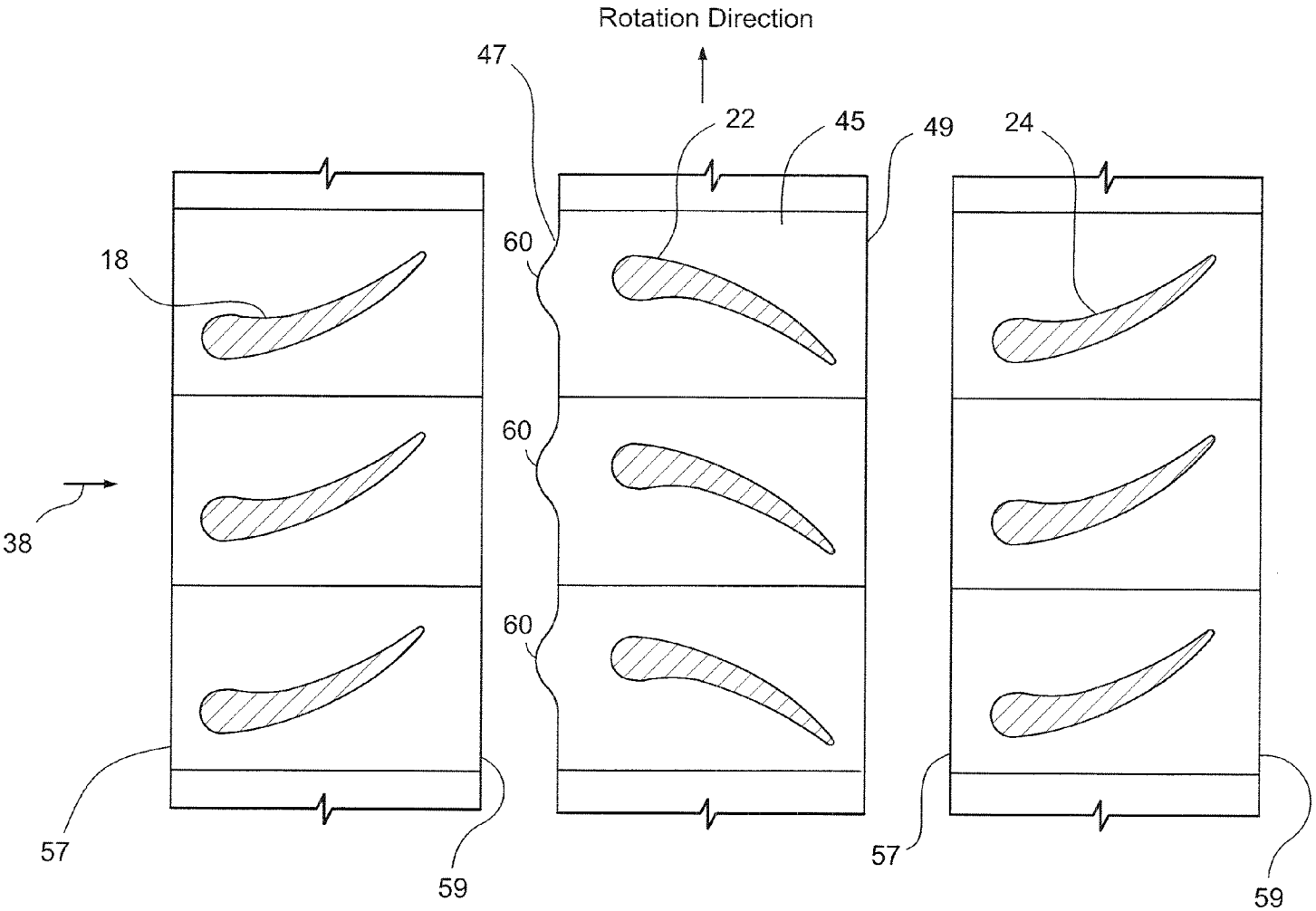
FIG. 6 is a partial cross-sectional view showing in a row of turbine blades positioned between two adjacent rows of nozzles.

FIG. 6 illustrates another alternate embodiment where curved portions 60 are only formed on the leading edges 47 of the turbine blade assemblies at locations corresponding to the leading edges of the turbine blades.

Figure 7:
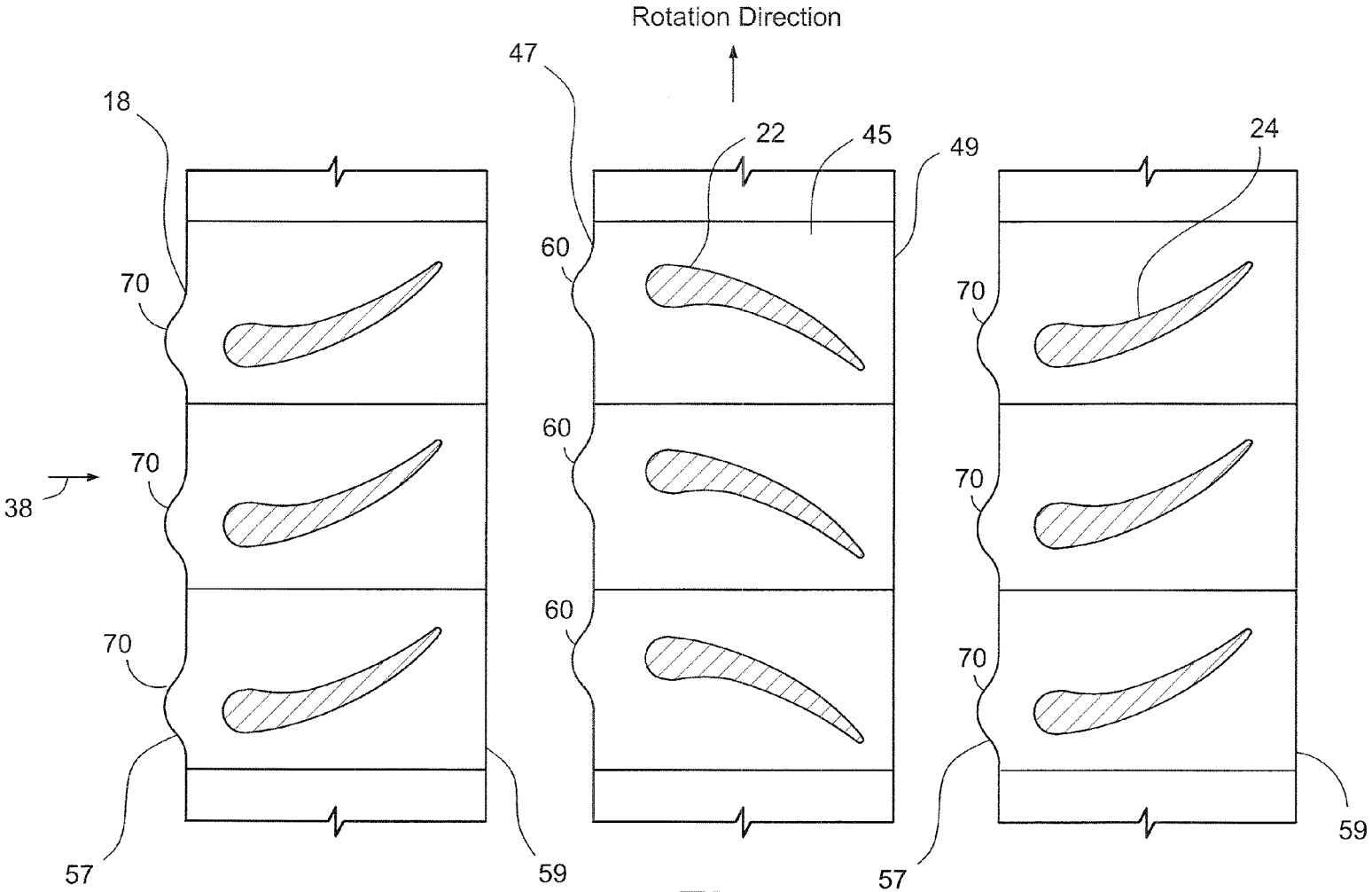
FIG. 7 is a partial cross-sectional view showing in a row of turbine blades positioned between two adjacent rows of nozzles.

FIG. 7 illustrates yet another alternate embodiment where curved portions are only formed on the leading edges of both the turbine blade assemblies and the nozzle assemblies. As shown in FIG. 7, curved portions 60 are formed on the leading edges 47 of the turbine blade assemblies as locations corresponding to the leading edges of the turbine blades. Also, curved portions 70 are formed on the leading edges of the nozzle assemblies at locations corresponding to the leading edges of the nozzle blades.

Figure 8:
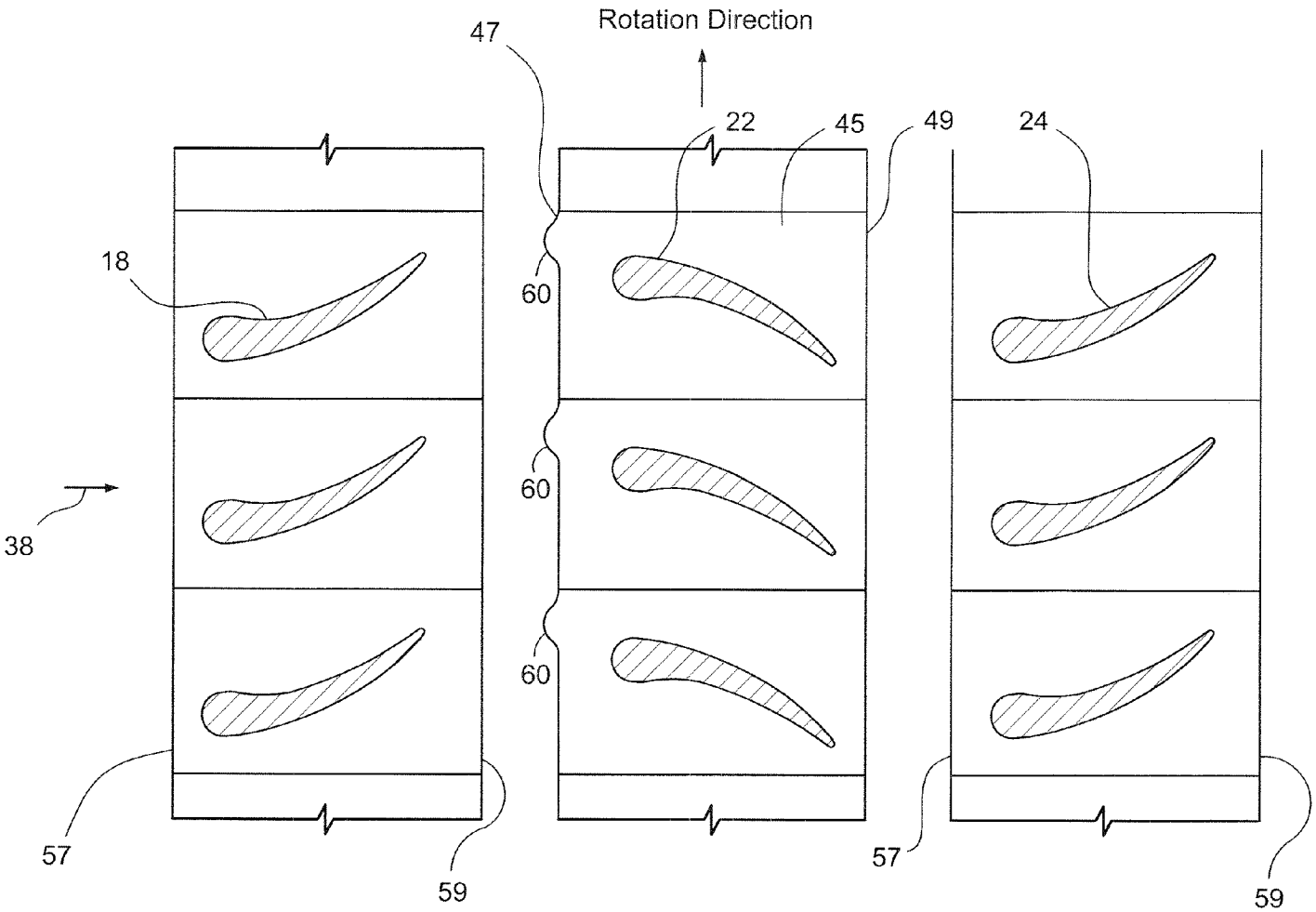
FIG. 8 is a partial cross-sectional view showing in a row of turbine blades positioned between two adjacent rows of nozzles.

FIG. 8 illustrates yet another alternate embodiment where the curved portions 60 formed on the leading edge 47 of the turbine blade assemblies are offset with respect to the leading edges of the turbine blades. As illustrated in FIG. 8, the curved portions 60 are located to the side of the turbine blades located in the direction that the turbine blades will move as they rotate within the turbine. In other alternate embodiments, curved portions could be formed on the leading edges of the nozzle assemblies at locations which are also offset from the leading edges of the nozzles. Likewise, the curved portions formed on trailing edges of either the turbine blade assemblies or the nozzle assemblies could also be offset from the corresponding trailing edges of the turbine blades and nozzles. Experimentation could be used to determine the optimum locations for the curved portions on the leading and/or trailing edges of the turbine blade and nozzle assemblies. Accordingly, various embodiments of the invention include locating the curved portion at any location on the leading and trailing edges of the turbine blade assemblies and nozzle assemblies.

Figure 9:
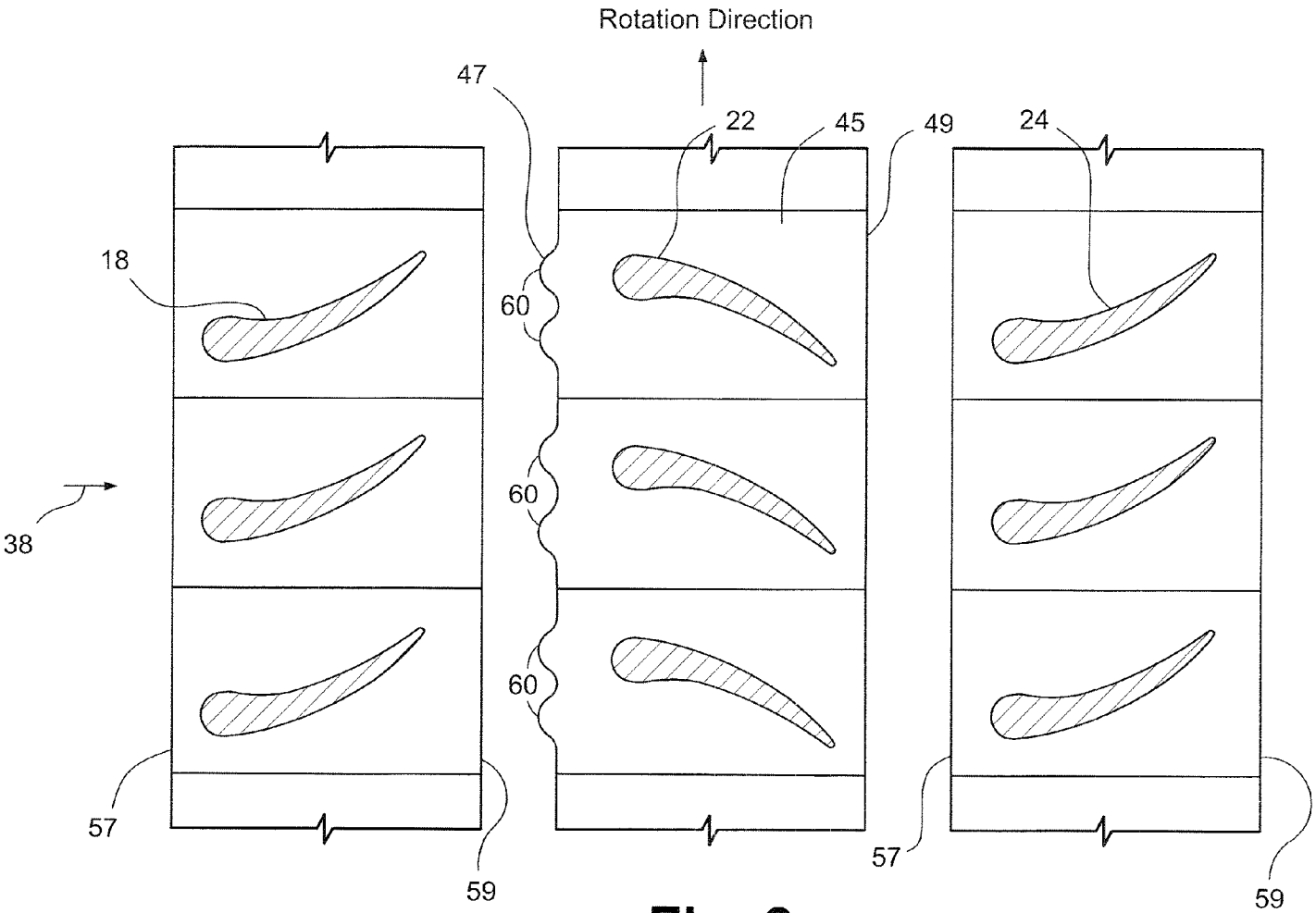
FIG. 9 is a partial cross-sectional view showing in a row of turbine blades positioned between two adjacent rows of nozzles.

In addition, it may be advantageous to include multiple curved portions on each individual turbine blade assembly or nozzle blade assembly. FIG. 9 illustrates an embodiment in which two curved portions 60 are located on the leading edge of the turbine blade assemblies. In other alternate embodiments, more than two curved portions may be formed on the leading edge of each individual turbine blade assembly. Likewise, in other alternate embodiments, two or more curved portions could be formed on the trailing edges of the turbine blade assemblies. Further, two or more curved portions could be formed on the leading edges and trailing edges of the individual nozzle assemblies.

Figure 10:
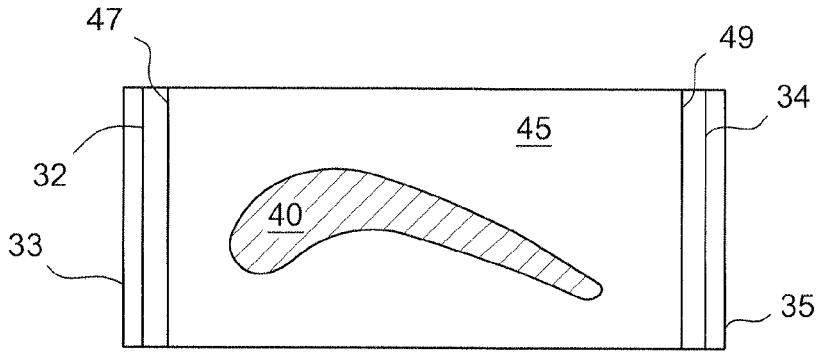
Fig. 10 Background Art
FIG. 10 is a top view of a blade assembly.

FIG. 10 illustrates a top view of a background art turbine blade assembly, like the one illustrated in FIG. 2. As shown in FIG. 10, the turbine blade 40 is mounted on top of the base 45 of the turbine blade assembly. The base 45 includes a leading edge 47 and a trailing edge 49. In the embodiments shown in FIGS. 2 and 10, the leading edge 47 and trailing edge 49 of the base 45 are straight. In addition, the leading edges of the angel wings 32, 33 on the leading side of the turbine blade assembly are also straight. Likewise, the trailing edges of the angel wings 34, 35 on the trailing side of the turbine blade assembly are also straight.

Figure 11:
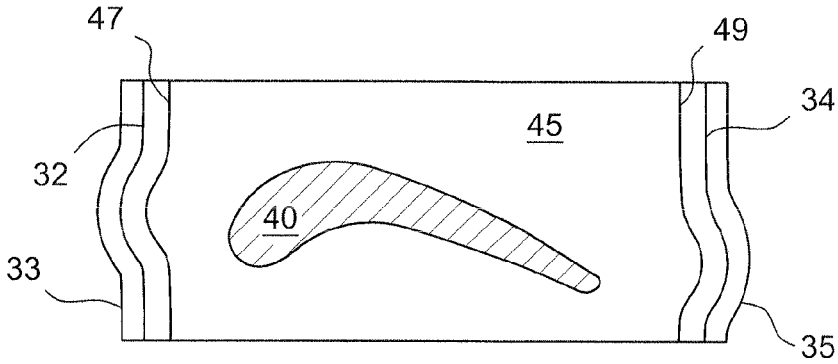
FIG. 11 is a top view of a blade assembly where the leading and trailing edges of the base and the angel wings include curved portions.

For reasons similar to those discussed above, the inventors believe that it may also be advantageous to provide curves on the leading and trailing edges of the angel wings. FIG. 11 illustrates an embodiment where the leading edges of the angel wings 32, 33 on the leading side of the turbine blade assembly include curves which correspond to a curve on the leading edge 47 of the base 45 of the turbine blade assembly. Likewise, the trailing edges of the angel wings 34, 35 on the trailing side of the turbine blade assembly also include curves which correspond which correspond to the curve on a trailing edge 49 of the base 45 of the turbine blade assembly.

Figure 12:
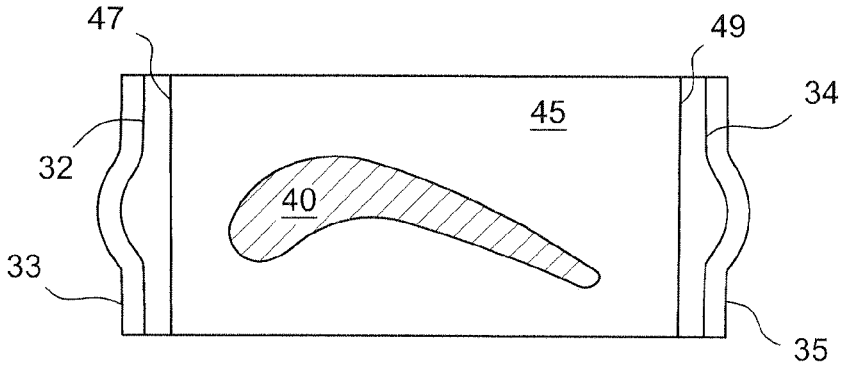
FIG. 12 is a top view of a blade assembly where the leading and trailing edges of the base are straight and the leading and trailing edges of the angel wings have curved portions.

FIG. 12 illustrates another alternate embodiment. In FIG. 12, the leading edge 47 and trailing edge 49 of the base 45 of the turbine blade assembly are both straight. However, curved portions are provided on the leading edges of the angel wings 32, 33 on the leading edge side of the turbine blade assembly. Likewise, curves are provided on the trailing edges of the angel wings 34, 35 on the trailing side of the turbine blade assembly.

Figure 13:
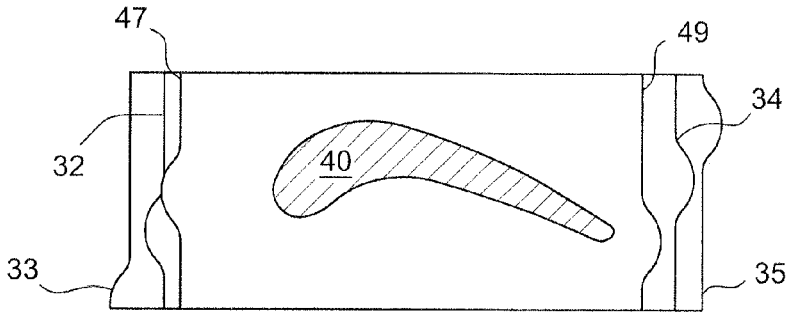
FIG. 13 is a top view of a blade assembly where the leading and trailing edges of the base and the angel wings have curved portions which are offset from one another.

FIG. 13 illustrates another alternate embodiment where curves are provided on the leading edge 47 and trailing edge 49 of the base 45 of the turbine blade assembly. Curves are also provided on the leading edges of the angel wings 32, 33 and the leading edge side of the turbine blade assembly, and on the angel wings 34, of the trailing edge side of the turbine blade assembly. However, the curves provided in each of these places are staggered with respect to each other.

Figure 14:
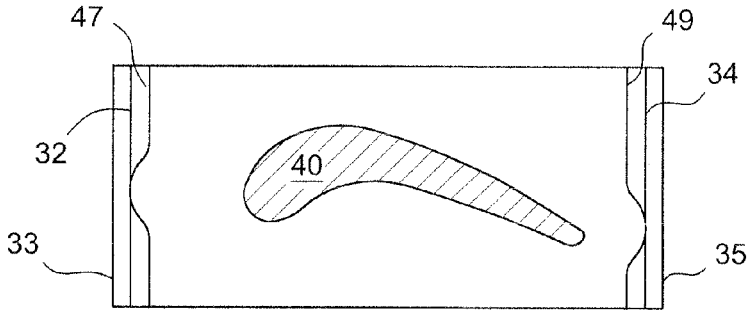
FIG. 14 is a top view of a blade assembly where the leading and trailing edges of the base have curved portions.

FIG. 14 illustrates yet another alternate embodiment where curves are only provided on the leading edge 47 and trailing edge 49 of the base 45 of a turbine blade assembly. No curves are provided in the angel wings on the leading edge side or the trailing edge side of the turbine blade assembly.

FIGS. 11-14 are intended to illustrate various different combinations of curves provided on the leading edge and trailing edge of the base of the turbine blade assemblies and the angel wings. Any combinations of curves, whether they be aligned with one another or offset with one another would also fall within the scope of the invention.

In the embodiments described above, a curved surface can be added to the leading edges and the trailing edges of turbine blade assemblies and nozzle blade assemblies. In the embodiments illustrated above, the curves are basically arcuate-shaped. In alternate embodiments, the curved portions might include a variety of different shapes, including Bezier curves, and abrupt and/or non-linear shapes, to improve their performance. In addition, because the turbine blade assemblies and nozzle assemblies are positioned adjacent to one another, the adjoining portions of two individual turbine blade assemblies or two individual nozzle assemblies could cooperate to form the overall curved surfaces on the leading edges and trailing edges.

Moreover, the curved portions on the leading edges and trailing edges of the nozzle blade assemblies and turbine assemblies could have a complex three dimensional shape. Here again, experimentation could be conducted to determine the shape and configuration for the curved surfaces. However, providing these curved surfaces on the leading and trailing edges could serve to reduce the amount of hot combustion gases which penetrate into the wheel space, thereby increasing the overall efficiency of the turbine.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A blade assembly for a turbine, comprising:

a mounting portion that is configured to be coupled to a rotating shaft of a turbine;

a base that is formed on a top of the mounting portion, wherein a leading edge of the base includes at least one curved portion that extends forward from the leading edge of the base, the at least one curved portion extending along only a portion of the leading edge of the base, the base including:

a leading angel wing formed on the leading side of the base, wherein at least one curved portion extends forward from a leading edge of the leading angel wing, the at least one curved portion extending along only a portion of the leading edge of the angel wing, wherein the at least one curved portions on the leading edge of the base and the leading edge of the leading angel wing have corresponding shapes, and wherein a location of the at least one curved portion on the leading edge of the leading angel wing is offset with respect to a location of the at least one curved portion on the leading edge of the base, and a trailing angel wing formed on the trailing side of the base; and a blade that extends upward from the top of the base.

2. The blade assembly of claim 1, wherein the at least one curved portion on the leading edge of the base is located adjacent a leading edge of the blade on the base.

3. The blade assembly of claim 1, wherein the at least one curved portion on the leading edge of the base is located to one side of a leading edge of the blade on the base.

4. The blade assembly of claim 3, wherein the at least one curved portion on the leading edge of the base is located to the side of the leading edge of the blade which is in the direction that the blade assembly will travel as it rotates in a turbine.

5. The blade assembly of claim 1, wherein the at least one curved portions comprise a plurality of curved portions.

6. The blade assembly of claim 1, wherein a trailing edge of the base includes at least one curved portion that extends rearward from the trailing edge of the base, the at least one curved portion extending along only a portion of the trailing edge of the base, and wherein the outer edge of the trailing angel wing includes at least one curved portion that extends rearward from the trailing edge of the trailing angel wing, the at least one curved portion extending along only a portion of the trailing edge of the trailing angel wing.

7. The blade assembly of claim 6, wherein the at least one curved portions on the trailing edge of the base and the trailing edge of the trailing angel wing have corresponding shapes.

8. The blade assembly of claim 7, wherein a location of the at least one curved portion on the trailing edge of the trailing angel wing is offset with respect to a location of the at least one curved portion on the trailing edge of the base.

9. A turbine comprising the blade assembly of claim 1.

10. A stationary nozzle assembly for a turbine, comprising:

a first mounting portion that is configured to be attached to an interior of a turbine casing;

a nozzle blade having a first end attached to the first mounting portion; and a second mounting portion attached to a second end of the nozzle blade, wherein the second mounting portion comprises:

a nozzle base having leading and trailing edges, wherein the leading edge of the nozzle base includes at least one curved portion that extends forward from the leading edge of the nozzle base, the at least one curved portion extending along only a portion of the leading edge of the nozzle base, and a leading angel wing, wherein at least one curved portion that extends forward is formed on a leading edge of the leading angel wing, the at least one curved portion extending along only a portion of the leading edge of the leading angel wing, wherein a shape of the at least one curved portion on the leading edge of the leading angel wing corresponds to a shape of the at least one curved portion on the leading edge of the nozzle base, and wherein a location of the at least one curved portion on the leading edge of the leading angel wing is offset with respect to a location of the at least one curved portion on the leading edge of the nozzle base.

11. The nozzle assembly of claim 10, wherein a trailing edge of the nozzle base also includes a at least one curved portion that extends rearward from the trailing edge of the nozzle base, and wherein the nozzle base further includes a trailing angel wing, wherein at least one curved portion that extends rearward is formed on a trailing edge of the trailing angel wing, and wherein a shape of the at least one curved portion on the trailing edge of the trailing angel wing corresponds to a shape of the at least one curved portion on the trailing edge of the nozzle base.

12. The nozzle assembly of claim 10, wherein the at least one curved portion on the leading edge of the nozzle base is located adjacent a leading edge of the nozzle blade on the nozzle base.

13. The nozzle assembly of claim 10, wherein the at least one curved portion on the leading edge of the nozzle base is located to one side of a leading edge of the nozzle blade on the nozzle base.

14. The nozzle assembly of claim 10, wherein the at least one curved portions on the leading edge of the nozzle base and the leading edge of the leading angel wing comprise a plurality of curved portions.

15. A turbine comprising the nozzle assembly of claim 10.

* * * * *

UNITED STATES PATENT AND TRADEMARK OFFICE

CERTIFICATE OF CORRECTION

PATENT NO. : 9,039,375 B2
APPLICATION NO. : 12/551741
DATED : May 26, 2015
INVENTOR(S) : Kneeland et al.

It is certified that error appears in the above-identified patent and that said Letters Patent is hereby corrected as shown below:

In the Specification

At column 3, line 1, insert -- III-III -- after "along line"

Signed and Sealed this
Fifteenth Day of September, 2015

Michelle K. Lee

Michelle K. Lee
*Director of the United States Patent and Trademark Office*